United States Patent [19]

Bernstein

[11] 4,079,673

[45] Mar. 21, 1978

[54] RAISED PRINTING ON LIGHT-TRANSMITTING SHEET MATERIAL

[76] Inventor: Donald J. Bernstein, 2 Grover Ter., Fairlawn, N.J. 07401

[21] Appl. No.: 645,370

[22] Filed: Dec. 30, 1975

[51] Int. Cl.[2] ..... B41M 3/00

[52] U.S. Cl. ..... 101/426; 283/8 R; 427/197

[58] Field of Search ..... 283/8 R; 101/426, 1, 101/419, 420; 427/197, 199, 202, 205, 265

[56] References Cited

U.S. PATENT DOCUMENTS

| | | | |
|---|---|---|---|
| 510,597 | 12/1893 | Guillanme | 427/199 |
| 594,655 | 11/1897 | Schumacher | 101/426 |
| 2,099,879 | 11/1937 | Wooddell | 101/420 |
| 2,734,452 | 2/1956 | Rausch | 101/426 |
| 3,121,642 | 2/1964 | Biskup | 427/199 |
| 3,192,063 | 6/1965 | Donofrio | 427/199 |
| 3,440,076 | 4/1969 | Vaurio | 101/426 |

FOREIGN PATENT DOCUMENTS

| | | | |
|---|---|---|---|
| 14,973 of | 1891 | United Kingdom | 283/8 R |

*Primary Examiner*—Clifford D. Crowder
*Assistant Examiner*—William Pieprz
*Attorney, Agent, or Firm*—Barry G. Magidoff

[57] ABSTRACT

This invention provides an improved process for imprinting light-transmitting, i.e., translucent to transparent, sheet material wherein the opposite faces of the sheet are initially imprinted with substantially exactly registering, mirror images. At least one side thereof, has a raised imprint formed thereon by applying a raised printing material onto the wet ink of the initial imprint, e.g., by the thermographic method.

This process is especially applicable to heat resistant plastics, especially polyesters.

8 Claims, 2 Drawing Figures

RAISED PRINTING ON LIGHT-TRANSMITTING SHEET MATERIAL

Figure 1:
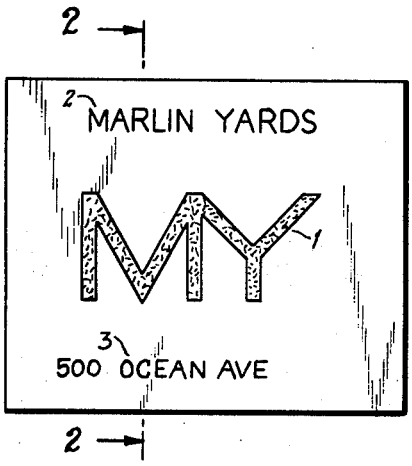

This invention is directed to an improved procedure for applying raised printing onto a light-transmitting sheet, or film, material. The invention is especially desirable in that it permits achieving the preferred appearance of genuine engraving on material which is not readily susceptible to true engraving.

Modern sheet material, including materials used for stationery, business or personal visiting cards, and business forms, have included not only improved quality papers, but also synthetic polymeric, i.e., "plastic", sheet material. Such synthetic polymeric sheet material includes both opaque, translucent, and fully transparent materials. Printers have learned how to imprint these materials, utilizing various inks, which are specially formulated to be at least temporarily adherent to the polymeric plastic.

Among the more recent developments in the printing art has been the so-called "two-sided" printing used on translucent or semi-transparent sheet materials. Such printing procedure requires the utilization of two exactly registering imprints on opposite faces of the sheet material. The art has utilized a wide range of methods for printing on synthetic polymer plastic, as well as the more advanced papers, and have included such processes as photolithography, letter-press printing, silk screen printing, and thermography, i.e., in the application of raised lettering to a face of the sheet material. One problem which has been commonly faced by persons utilizing the thermographic, or raised lettering, printing procedure, is the difficulty of applying a completely even coating, especially onto a synthetic polymeric plastic. The application of insufficient amount of the imprinting material, or insufficient heat treatment to assure a complete bond between the plastic sheet material and the thermographic powder, often results in a product which either initially has an unsatisfactory appearance, lacking opacity or depth, or upon handling, is scratched such that the raised lettering is removed, leaving unattractive-appearing light spaces in the imprinted material. This is especially undesirable when the main reason for the raised lettering is to simulate the appearance of genuine engraving, or intaglio.

It has now been discovered that an especially effective method for imprinting with raised lettering onto transparent and/or translucent sheet material is the application of raised printing onto one side of the transparent or translucent sheet material and the application of direct registering imprint on the reverse face of the transparent or translucent sheet material. This procedure provides an improved product, which is not as susceptible to disfigurement upon handling, and provides an improved initial appearance, as to opacity and depth.

Although this procedure is adaptable to the lighter weight, translucent papers, such as onion skin and other papers having a "weight" of less than about 18, the process is most especially useful with those synthetic polymeric plastic sheet materials which cannot be effectively imprinted with genuine engraving. The extremely tough, high-melting thermoplastic sheet materials, which are especially desirable because of these physical properties, giving them great durability and strength, also are exceedingly difficult to genuine engrave because of these very same properties. Accordingly, when it is desirable to achieve a somewhat improved appearance than is obtainable with the usual flat printing procedures, genuine engraving is not available for use on these materials. In such cases, the use of the so-called raised printing, such as thermography, is a necessity.

The process of this invention is generally carried out by initially imprinting the translucent or transparent sheet material on both faces with direct register printing procedures, such that identical, but mirror-image, imprints are formed on the opposite faces of the sheet. The precise registry of the opposing imprints is extremely important in order to obtain a clear, precise and opaque attractive image. The two mirror images can be applied simultaneously or successively. Preferably, the two images are applied simultaneously in order to attain the most precise direct registry, and further, to obtain a most efficient operation.

After the initial images are applied onto the sheet material, and necessarily before the ink has dried, thermographic powder is applied onto at least one of the surfaces of the sheet so as to cover the wet ink areas. The powdered sheet, is then subjected to heat sufficient to dry and adhere the powder, as continuous raised printing, onto the surface of the sheet. The method of printing and the method of applying the raised powder material are conventional in the art and do not form, in themselves, a part of this invention. These procedures are all well known to the art. The initial printing, i.e., the direct registry to both sides of the sheet, can be applied by any conventional process, although generally when only verbal material is being imprinted, a letter press is the preferred method for initially applying the ink for use with thermographic, or raised, printing. However, other procedures, including preferably photolithography, but also including photogelatin, or even silk screen printing can be utilized, especially when designs or pictures are to be imprinted, and not only a verbal message. The opposing images can be simultaneously imprinted by simultaneously applying to the opposing faces the desired printing elements. One such commercially used procedure is known as the "Transface" printing process of Pedeco Printing Corporation.

Figure 2:
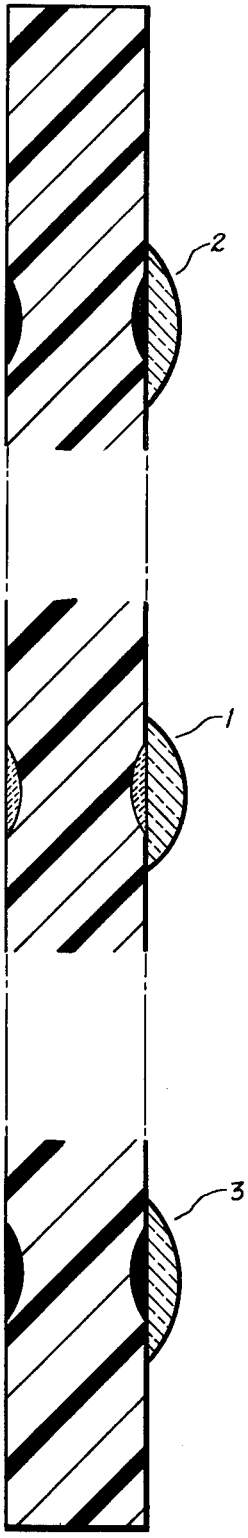

A more complete understanding of the product of the process of the present invention can be had by reference to the accompanying drawings:

FIG. 1 is a plan view showing a card imprinted with raised printing in accordance with the process of the present invention; and FIG. 2 is a cross-sectional view taken along lines 2—2 of FIG. 1.

Referring to the drawings, all of the printing shown on the top surface of the card of FIGS. 1 and 2 is raised printing. The upper imprint 2 and lower imprint 3 on the card in the drawings are full value imprints, i.e., having a value of 100 as a tint value. The imprinted logo 1 at the center of the card, is also raised printing, but the imprint on the front and reverse side of the card is done at a lesser tint value, for example 50. The card is a light-transmitting sheet of polyester.

Although as stated above, the procedure of this invention is applicable for use on the lighter weight, semi-transparent or translucent papers, i.e., those having a weight of not greater than about 18 pounds per square foot, the process is most effectively applicable to the imprinting of those tough, high-melting, synthetic polymeric plastics, generally thermoplastic, sheet material, which are not readily susceptible to genuine engraving, or intaglio printing. These materials, for the same reasons that render them tough and durable, cannot be engraved easily, include polyesters, especially poly(ethylene terephthalate); polycarbonates, i.e. a reaction product of a di-hydroxy compound and a carbonate diester, and specifically presently commercially available is the derivative of bisphenol A and phosgene; nylon; the available fluoroplastics; medium and high density polyethylene; polypropylene; and polyurethane film. The above materials are the materials which are presently commonly available commercially and which have the desirable high-heat resistance, which is capable of withstanding the heat utilized during the drying and curing of the thermographic powder.

The desirable sheet materials generally have a thickness of not greater than about 0.1 inch, and preferably not greater than about 0.05 inch. Optimally, these sheet materials have a thickness of at least about 0.0012 inch.

As stated above, the sheet materials especially useful in this invention are at least translucent and may even be transparent. The preferred transmittance of visible light is at least about 30 percent, and preferably, at least about 50 percent. Completely transparent materials are not always desirable for use, and thus, the preferred sheet materials have a maximum transmittance of not greater than about 90 percent, and/or a "percent haze" of at least about 5 percent, when the sheet is otherwise transparent.

When carrying out the process of this invention by high-speed modern printing procedures, wherein the thermographic powder is to be applied to one side of the sheets only, the printed sheets containing the undried thermographic powder are placed onto a moving conveyor belt; it is desirable in order to insure no powder adheres to the wet ink on the reverse side, that either the conveyor surface be maintained scrupulously clean and/or that blank interleafs should be maintained between the printed sheet and the conveyor surface. This prevents any thermographic powder on the conveyor from adhering to the wet reverse image, on the opposite face of the sheet.

The raised printing, or thermographic, powder need not be applied to the entire printed image formed by, e.g., photolithography. For example, only a portion of a letterhead, e.g., the name, may be desired to be raised. Similarly, only one part of a business card may be desired to be a raised imprint. When the process of this invention is applied to the preparation of business forms, only a portion of the form must be raised, for example a heading, and the remaining portion of the imprinted form, which can comprise a gridwork of lines, for example, could remain as flat printing. Similarly, a background can be imprinted onto both surfaces of the sheet material, such as for example, a simulated parchment appearance. The background, and/or gridwork of lines, can be imprinted prior to the carrying out of the present process, such that the ink on this material will be dry prior to the application of the powder; alternatively, the entire flat imprint can be applied simultaneously, at least where a single color is being utilized, and the thermographic powder is applied only to those portions of the flat imprint which are desired to be raised. The entire printing job is then simultaneously dried. It is pointed out that although the color of the entire simultaneously applied imprint must be the same, the screen value, or tint value, need not be the same; the background or lines may be lighter or darker than the imprinted verbal information, or design. It is pointed out, that the art is well aware of procedures for limiting the application of the thermographic powder to any desired portion of an imprinted surface. This, again, is not a part of the present invention, but a part of the recognized prior art.

The term "tint value" or "tint" is commonly used in the printing trade to indicate an area of even tone or strength of a solid color, see "*Pocket Pal,* a *Graphic Arts Production Handbook,*" 11th Edition, published by the International Paper Company, 1974, page 184. A "screen," to obtain a screen value, is one method of obtaining a tint value, or tone less than the solid, or full, color by converting the image into dots or lines of various sizes, the tone value being related to the number of dots or lines per inch provided by the screen in carrying out the process.

The term thermography, is used not only to include the specific method of applying a fusible powder onto a wet-ink surface, but also should encompass other methods of forming raised printing, or synthetic engraving, whereby the ink is caused to present a surface raised above the surface of the sheet by a measurable amount.

Generally, thermographic powder is a size-graded pulverized, granular thermoplastic resin. The commonly available material is believed to be a polyamide resin. The thermographic imprint can be presented in a variety of colors. All colors except the metallic colors, such as gold, silver or copper, are obtained by imprinting, as by photolithography, using an ink of the desired color, and then applying a clear, colorless thermographic powder. The metallic colors are obtained by initially imprinting with an ink of a color similar to the desired metal, and then using a metallic-colored thermographic powder.

The examples and procedures set forth above are intended to be merely exemplary of the full scope of this invention, and should not be taken as exclusive, or limiting thereof. The scope of the invention is set forth by the following claims.

The patentable embodiments of this invention, which are claimed, are:

1. An improved process for providing raised printing onto a light-transmitting sheet surface, the process comprising:

imprinting with a liquid ink onto both faces of a light-transmitting sheet, having a transmittance of light in the visible range of at least about 50%, mirror-image imprints in exact registry with each other;

the tint value of one portion of the imprints, and the corresponding mirror-image, direct registry flat printing on the reverse side, being of a different tint value from another portion thereof;

applying to at least a portion of each of the different tint value imprints, on one face of the sheet, material suitable for forming a raised imprint thereon and which will adhere to the wet imprinted ink;

and drying the raised printing material, causing it to fuse and adhere to the surface of the sheet.

2. The process of claim 1 wherein the tint value is a screen value.

3. The process of claim 1, wherein the sheet is a synthetic polymeric plastic material, selected from the group consisting of polyesters, polycarbonates, nylon, fluoroplastics, medium and high-density polyethylene, polypropylene and polyurethane.

4. The process of claim 3, wherein the sheet material has a thickness not greater than about 0.05 inch.

5. The process of claim 4, wherein the sheet material is a sheet of poly(ethylene terephthalate).

6. The process of claim 1, wherein the raised imprint is formed by applying thermographic powder.

7. The process of claim 6, comprising in addition, transporting imprinted, but undried, sheets subsequent to applying thermographic powder to a dryer on the surface of a conveyor means wherein a sheet of dry non-adherent material is interleaved between each sheet and the conveyor surface so as to prevent any accidental adherence of powder to the wet imprint on the reverse side.

8. An improved imprinted product, having raised printing formed thereon on one side thereof, and having flat printing over at least a portion of its reverse surface, as an exact mirror image in direct registry with the raised printing on the first side, the product comprising a light-transmitting sheet material having a transmittance of light in the visible range of at least about 50%, and wherein the tint value of one portion of the raised printing and the corresponding mirror-image, direct registry flat printing on the reverse side is different from the tint value of another portion thereof.

* * * * *